US010996621B2

(12) United States Patent
Matsumoto

(10) Patent No.: US 10,996,621 B2
(45) Date of Patent: May 4, 2021

(54) IMAGE FORMING APPARATUS INCLUDING A MECHANISM TO CONTROL CONTACT BETWEEN A PHOTOSENSITIVE MEMBER AND A DEVELOPER BEARING MEMBER

(71) Applicant: CANON KABUSHIKI KAISHA, Tokyo (JP)

(72) Inventor: Hiroshi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/791,462

(22) Filed: Feb. 14, 2020

(65) Prior Publication Data

US 2020/0272094 A1 Aug. 27, 2020

(30) Foreign Application Priority Data

Feb. 26, 2019 (JP) ..... JP2019-033289

(51) Int. Cl.
*G03G 21/18* (2006.01)
*G03G 21/16* (2006.01)

(52) U.S. Cl.
CPC ..... *G03G 21/1842* (2013.01); *G03G 21/1633* (2013.01); *G03G 21/1825* (2013.01)

(58) Field of Classification Search
CPC ..... G03G 21/1842; G03G 21/185
See application file for complete search history.

(56) References Cited

U.S. PATENT DOCUMENTS 8,565,639 B2 * 10/2013 Nittani ..... G03G 21/1821 399/111
9,684,279 B2 * 6/2017 Nakamura ..... G03G 21/1647
2015/0063834 A1 * 3/2015 Kobayashi ..... G03G 15/043 399/12

FOREIGN PATENT DOCUMENTS

JP 2015072457 A 4/2015
JP 2016161627 A 9/2016
JP 2017167522 A 9/2017

* cited by examiner

*Primary Examiner* — Arlene Heredia
(74) *Attorney, Agent, or Firm* — Canon U.S.A., Inc. I.P. Division

(57) ABSTRACT

An image forming apparatus includes a movement mechanism. The movement mechanism moves a pressing mechanism from a first position to a second position along with a start of an image forming operation and moves the pressing mechanism from the second position to the first position along with an end of the image forming operation, when image formation is carried out. The movement mechanism moves the pressing mechanism from the first position to the second position along with detection by a detection unit that a main body cover is opened, when the image formation is not carried out.

5 Claims, 8 Drawing Sheets

COMPARATIVE EXAMPLE

COMPARATIVE EXAMPLE

IMAGE FORMING APPARATUS INCLUDING A MECHANISM TO CONTROL CONTACT BETWEEN A PHOTOSENSITIVE MEMBER AND A DEVELOPER BEARING MEMBER

BACKGROUND OF THE DISCLOSURE

Field of the Disclosure

The present disclosure relates to an image forming apparatus to which a cartridge including a photosensitive member and a developer bearing member can be detachably attached.

Description of the Related Art

Regarding an image forming apparatus to which a cartridge including a photosensitive member and a development roller can be detachably attached, a configuration is known that makes the development roller abut on the photosensitive member when image formation is carried out and separates the development roller from the photosensitive member when the image formation is not carried out (for example, Japanese Patent Application Laid-Open No. 2016-161627).

If the development roller is kept abutting on the photosensitive member for a long period while the image formation is not carried out, the development roller may warp and an image defect may occur when the image formation is carried out. It is desirable to keep the development roller separated from the photosensitive member when the image formation is not carried out to prevent occurrence of such an image defect.

Therefore, according to the configuration discussed in Japanese Patent Application Laid-Open No. 2016-161627, a separation lever presses the cartridge mounted on an image forming apparatus to keep the development roller in the state being separated from the photosensitive member when the image formation is not carried out. However, when the cartridge is attached/detached to/from the image forming apparatus in a state where the separation lever is placed at a position where it presses the cartridge mounted on the image forming apparatus, resistance is developed subject to the pressing by the separation lever, which may make smooth attachment and detachment of the cartridge difficult.

Thus, in a configuration that makes the development roller abut on the photosensitive member when the image formation is carried out, and separates the development roller from the photosensitive member when the image formation is not carried out, a new configuration is desired that enables smooth attachment and detachment of the cartridge to and from the mounting portion at the time of replacement of the cartridge.

SUMMARY OF THE DISCLOSURE

The present disclosure is directed to improving operability when the cartridge is attached to and detached from the mounting portion when the image formation is not carried out, with respect to the configuration that makes the development roller abut on the photosensitive member when the image formation is carried out and separates the development roller from the photosensitive member when the image formation is not carried out.

Further, another object of the present disclosure is an image forming apparatus including a mounting portion to which a cartridge can be detachable attached. The cartridge includes a photosensitive member and a developer bearing member configured to bear a developer for developing an electrostatic latent image formed on the photosensitive member. The image forming apparatus includes a pressing mechanism configured to press the cartridge mounted on the mounting portion, a movement mechanism configured to move the pressing mechanism between a first position at which the pressing mechanism presses the cartridge mounted on the mounting portion and a second position at which the pressing mechanism does not press the cartridge mounted on the mounting portion, an openable and closable main body cover, and a detection unit configured to detect information regarding opening/closing of the main body cover. A position of the developer bearing member relative to the photosensitive member is placed at a separation position where the developer bearing member is separated from the photosensitive member when the pressing mechanism is placed at the first position in a state where the cartridge is mounted on the mounting portion, and the position of the developer bearing member relative to the photosensitive member is placed at a contact position where the developer bearing member is in contact with the photosensitive member when the pressing mechanism is placed at the second position in the state where the cartridge is mounted on the mounting portion. The movement mechanism moves the pressing mechanism from the first position to the second position along with a start of an image forming operation and moves the pressing mechanism from the second position to the first position along with an end of the image forming operation, when image formation is carried out. The movement mechanism moves the pressing mechanism from the first position to the second position along with detection by the detection unit that the main body cover is opened, when the image formation is not carried out.

Further, another object of the present disclosure is an image forming apparatus including a mounting portion to which a cartridge can be detachably attached. The cartridge includes a photosensitive member and a developer bearing member configured to bear a developer for developing an electrostatic latent image formed on the photosensitive member. The image forming apparatus includes a pressing mechanism configured to press the cartridge mounted on the mounting portion, a movement mechanism configured to move the pressing mechanism between a first position at which the pressing mechanism presses the cartridge mounted on the mounting portion and a second position at which the pressing mechanism does not press the cartridge mounted on the mounting portion, and a detection unit configured to detect information regarding whether the cartridge is mounted on the mounting portion. A position of the developer bearing member relative to the photosensitive member is placed at a separation position where the developer bearing member is separated from the photosensitive member when the pressing mechanism is placed at the first position, in a state where the cartridge is mounted on the mounting portion, and the position of the developer bearing member relative to the photosensitive member is placed at a contact position where the developer bearing member is in contact with the photosensitive member when the pressing mechanism is placed at the second position, in the state where the cartridge is mounted on the cartridge. The movement mechanism moves the pressing mechanism from the first position to the second position along with a start of an image forming operation and moves the pressing mechanism from the second position to the first position along with an end of the image forming operation, when image formation is carried out. The movement mechanism moves the pressing mechanism from the first position to the second position along with detection by the detection unit that the cartridge is not mounted on the mounting portion, when the image formation is not carried out.

Further features of the present disclosure will become apparent from the following description of example embodiments with reference to the attached drawings.

DESCRIPTION OF THE EMBODIMENTS

In the following description, an example embodiment of the present disclosure will be described in detail with reference to the accompanying drawings. However, the example embodiment that will be described below does not limit the present disclosure defined according to the claims, and not all of combinations of features that will be described in a first example embodiment are necessarily essential to a solution of the present disclosure. The present disclosure can be implemented for various applications, such as a printer, various types of printing machines, a copying machine, a facsimile (FAX) machine, and a multifunctional peripheral.

<Overall Configuration of Image Forming Apparatus>

Figure 1:
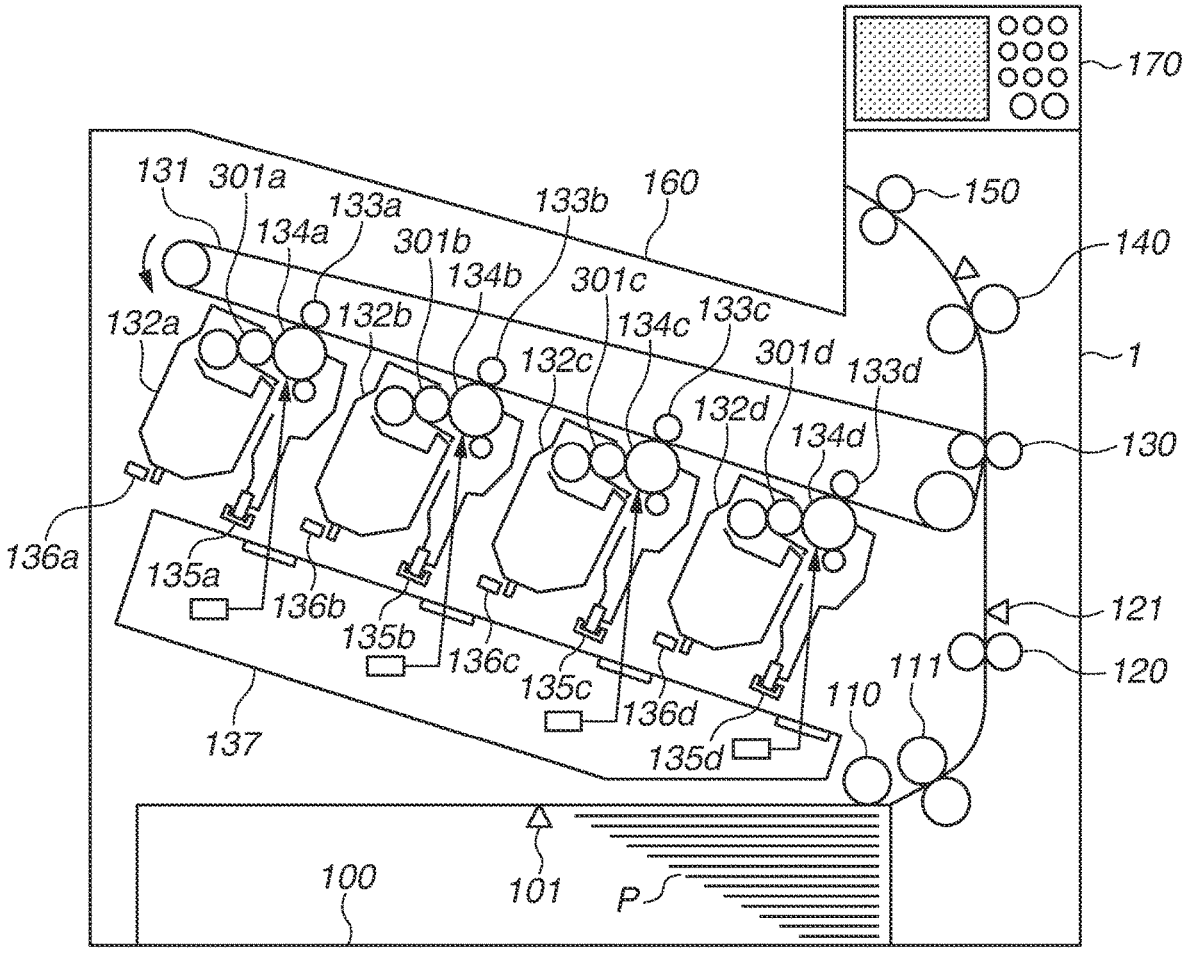
FIG. 1 a cross-sectional view illustrating an overall configuration of an image forming apparatus.

First, an overall configuration of an image forming apparatus according to the first example embodiment of the present disclosure will be described with reference to FIG. 1. FIG. 1 is a cross-sectional view of an image forming apparatus 1 according to the first example embodiment.

A sheet feeding cassette 100 is provided at the image forming apparatus 1 as a sheet feeding portion on which a sheet P (paper) to be used in printing is set. A cassette pickup roller 110 starts feeding of the sheet P, and the sheet P is separated and transmitted one by one by a cassette feed/retard roller 111. A presence/absence of the sheet P in the sheet feeding cassette 100 can be detected by a cassette sheet presence/absence sensor 101. The sheet P fed from the sheet feeding cassette 100 is conveyed to a registration roller 120, and, after that, whether the sheet P has been normally fed is detected by a registration sensor 121.

On the other hand, an image forming operation is started at cartridges 132*a* to 132*d* at a timing that makes the sheet P reach a secondary transfer portion 130 in time. The cartridges 132*a* to 132*d* are process cartridges including photosensitive drums 134*a* to 134*d* and development rollers 301*a* to 301*d*, respectively. The cartridge 132*a* forms a yellow image. The cartridge 132*b* forms a magenta image. The cartridge 132*c* forms a cyan image. The cartridge 132*d* forms a black image. Details of the cartridges 132*a* to 132*d* will be described below with reference to FIG. 3.

The cartridges 132*a* to 132*d* are configured such that a user (an operator) can detachably attach them to a mounting portion of the image forming apparatus 1, and the mounting portion of the cartridges 132*a* to 132*d* is exposed when a front door (a main body cover) is opened. The front door is provided on a front surface of the image forming apparatus 1, to be opened and closed. The cartridges 132*a* to 132*d* are mounted on the mounting portion of the image forming apparatus 1 by push-in along recessed rails 135*a* to 135*d* (guide units), in a direction from a front surface side toward a back surface side of the image forming apparatus 1.

Separation levers 136*a* to 136*d* (pressing levers) are provided to cause the development rollers 301*a* to 301*d* to abut on (contact) and separate from the photosensitive drums 134*a* to 134*d* (hereinafter referred to as development abutting and development separation). Details of a mechanism for the development abutting/separation will be described below with reference to FIG. 4.

Laser light is emitted from inside an optical unit 137, and is shed onto the photosensitive drums 134*a* to 134*d* of the cartridges 132*a* to 132*d* to irradiate them. Toner images formed on the photosensitive drums 134*a* to 134*d* are transferred onto an intermediate transfer belt 131 by application of primary transfer voltages at primary transfer portions 133*a* to 133*d*. Then, the toner images transferred on the intermediate transfer belt 131 reach the secondary transfer portion 130 by a rotation of the intermediate transfer belt 131.

After passing through the registration sensor 121, the sheet P is conveyed to the secondary transfer portion 130 at a timing synchronized with the toner images on the intermediate transfer belt 131. Then, a secondary transfer voltage is applied at the secondary transfer portion 130, and the toner images on the intermediate transfer belt 131 are transferred onto the sheet P. After that, the sheet P is conveyed from the secondary transfer portion 130 to a fixing portion 140, and the toner images are fixed due to heat and a pressure at the fixing portion 140. The sheet P on which the image formation is completed is discharged onto a sheet discharge tray 160 with a print surface face-down after reaching a sheet discharge roller 150.

An operation display unit 170 displays print information, a warning, and the like. Further, the operation display unit 170 is provided for the user to input various kinds of settings, such as print settings.

<Electric Control Configuration of Image Forming Apparatus>

Figure 2:
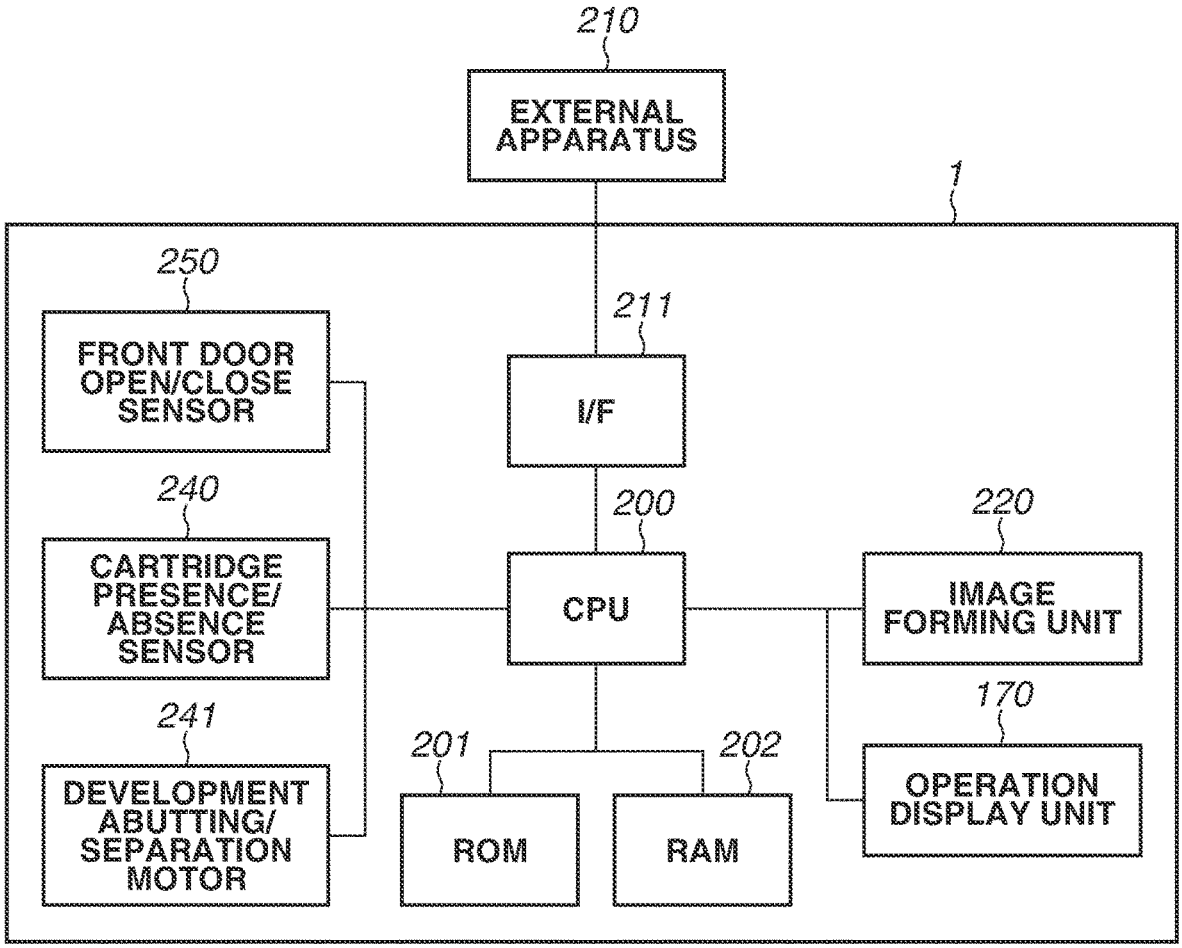
FIG. 2 is a control block diagram of the image forming apparatus.

Subsequently, an electric control configuration of the image forming apparatus 1 according to the first example embodiment will be described with reference to FIG. 2. FIG. 2 is a control block diagram of the image forming apparatus 1 according to the first example embodiment.

A central processing unit (CPU) 200 receives print information transmitted from an external apparatus 210 such as a personal computer (PC), via an interface (I/F) 211 such as a universal serial bus (USB) cable.

The CPU 200 controls the printing at the image forming apparatus 1 with use of the print information received from the external apparatus 210 according to a control program stored in a read-only memory (ROM) 201. At this time, the CPU 200 writes in and reads out processing data for the printing with use of a random-access memory (RAM) 202.

After the formed toner images are transferred onto the sheet P, the CPU 200 can fix these toner images by controlling an image forming unit 220.

The CPU 200 acquires information about an operation of the user via the operation display unit 170. Further, the CPU 200 (a control unit) displays the print information, the warning, and the like on the operation display unit 170.

The CPU 200 acquires (detects) information regarding whether the cartridges 132*a* to 132*d* are mounted on the mount portion of the image forming apparatus 1, from a cartridge presence/absence sensor 240 (a mounting detection unit).

The CPU 200 causes the development rollers 301*a* to 301*d* to abut on and separate from the photosensitive drums 134*a* to 134*d* in the cartridges 132*a* to 132*d* by a development abutting/separation motor 241.

The CPU 200 acquires (detects) information regarding opening/closing of the front door (the main body cover) of the image forming apparatus 1 from a front door open/close sensor 250 (a main body cover open/close detection unit).

<Description Regarding Configuration of Cartridge>

Figure 3:
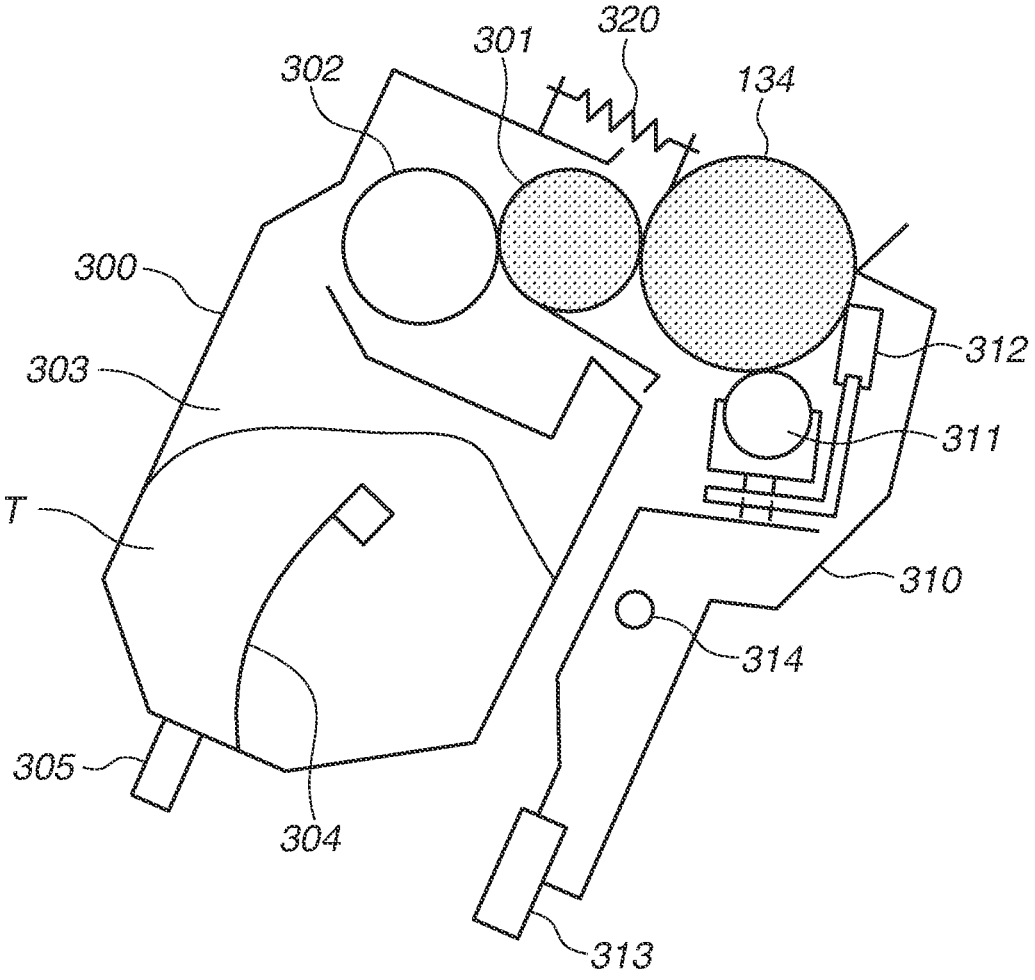
FIG. 3 is a cross-sectional view illustrating a configuration of a cartridge.

Next, a configuration of the cartridges 132*a* to 132*d* will be described with reference to FIG. 3. FIG. 3 is a cross-sectional view illustrating the configuration of the cartridges 132*a* to 132*d*.

As illustrated in FIG. 3, the cartridges 132*a* to 132*d* are configured such that a development unit 300 and a cleaning unit 310 are integrally provided therein.

First, a configuration of the development unit 300 will be described. Toner T (a developer) is contained in a toner storage portion 303, and is stirred by a toner stirring member 304. A toner supply roller 302 supplies the toner T to the development roller 301 (a developer bearing member). An electrostatic latent image (an electrostatic image) formed on the surface of the photosensitive drum 134 is developed by the development roller 301 as the toner image.

A pressing unit 305 is a member to be pressed by the separation lever 136 described above with reference to FIG. 1 for the development abutting/separation. A detailed relationship between the pressing unit 305 and the separation lever 136 will be illustrated below in a description about the mechanism for the development abutting/separation illustrated in FIG. 4.

Next, a configuration of the cleaning unit 310 will be described. A charging roller 311 evenly charges the surface of the photosensitive drum 134. The electrostatic latent image is formed on the surface of the charged photosensitive drum 134 by the laser light emitted from inside the optical unit 137 described above with reference to FIG. 1. A cleaning blade 312 removes the toner T remaining on the surface of the photosensitive drum 134 after the primary transfer.

A protruding guide 313 is a guide member for inserting the cartridges 132*a* to 132*d* into the image forming apparatus 1 along the recessed rails 135*a* to 135*d* described above with reference to FIG. 1.

The development unit 300 is coupled with a support shaft 314 provided in the cleaning unit 310. The development unit 300 is configured rotatably around the support shaft 314 relative to the cleaning unit 310.

Further, a tension spring 320 is provided between the development unit 300 and the cleaning unit 310, and a force is applied in a direction of making the development roller 301 and the photosensitive drum 134 abut on each other. In this manner, the cartridges 132*a* to 132*d* are configured such that the development roller 301 and the photosensitive drum 134 are brought into abutting with each other due to the force of the tension spring 320.

<Mechanism for Development Abutting/Separation>

Next, the mechanism for the development abutting/separation in the cartridges 132*a* to 132*d* will be described with reference to FIGS. 4A to 4E. FIGS. 4A to 4E illustrate the mechanism for the development abutting/separation.

First, an abutting/separation state between the development roller 301 and the photosensitive drum 134 when the cartridges 132*a* to 132*d* are not mounted on the mounting portion of the image forming apparatus 1 will be described with reference to FIG. 4A.

When the cartridges 132*a* to 132*d* are not mounted on the image forming apparatus 1, the development roller 301 and the photosensitive drum 134 are set in the abutting state on each other due to the force of the tension spring 320 as described above with reference to FIG. 3.

When the cartridge 132 is in a brand-new condition, the development roller 301 and the photosensitive drum 134 are kept in a state being separated from each other by a packing member. At this time, a relative position of the development roller 301 with respect to the photosensitive drum 134 is placed at a separation position where the development roller 301 is separated from the photosensitive drum 134.

Figure 4A:
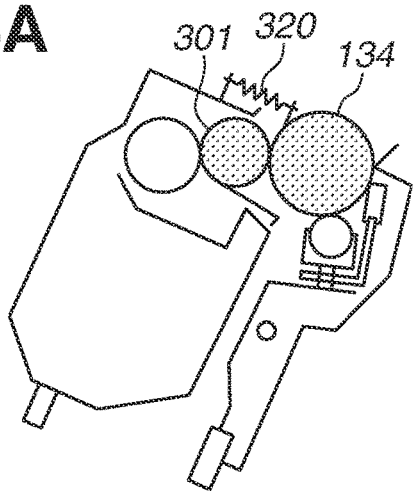
FIGS. 4A to 4E illustrate a mechanism for abutting/separating a development roller.

When the packing member is removed to mount the cartridge 132 in the brand-new condition to the image forming apparatus 1, the development roller 301 and the photosensitive drum 134 are brought into the state abutting on each other as illustrated in FIG. 4A. At this time, the relative position of the development roller 301 with respect to the photosensitive drum 134 is placed at a contact position where the development roller 301 is brought into contact with the photosensitive drum 134.

Next, a mechanism for switching the development abutting/separation when the cartridges 132*a* to 132*d* are mounted on the mounting portion of the image forming apparatus 1 will be described with reference to FIGS. 4B to 4E.

Figure 4B:
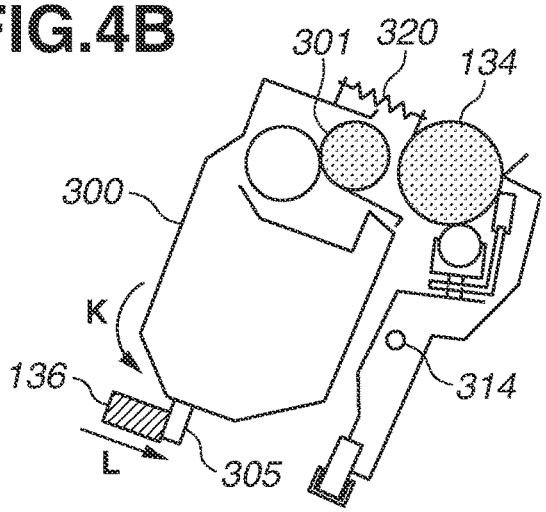
Figure 4D:
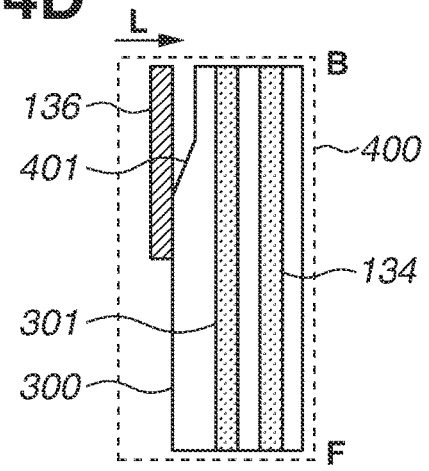
Figure 4C:
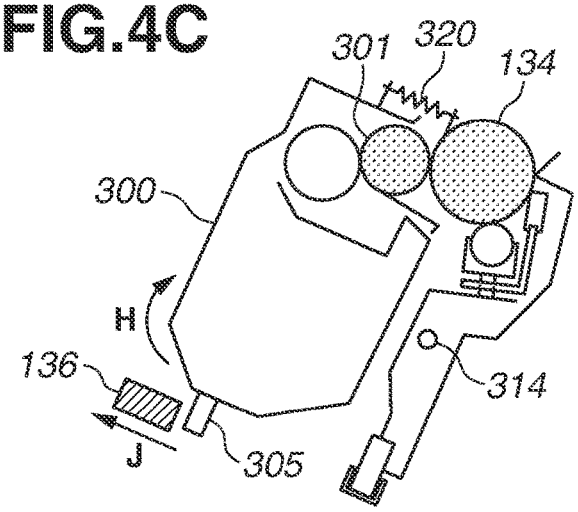

As illustrated in FIGS. 4B and 4C, the separation lever 136 (a main body lever) is provided at the mounting portion of the image forming apparatus 1 as described above with reference to FIG. 1. The separation lever 136 is a pressing mechanism for pressing the cartridges 132*a* to 132*d* mounted on the mounting portion of the image forming apparatus 1. The separation lever 136 is moved in either one of a direction indicated by an arrow L in FIG. 4B and a direction indicated by an arrow J in FIG. 4C driven by the development abutting/separation motor 241. A detailed relationship between the driving by the development abutting/separation motor 241 and the movement direction of the separation lever 136 will be described below in a description about development abutting/separation positions illustrated in FIGS. 5A to 5C.

As illustrated in FIG. 4B, when the separation lever 136 is moved in the direction indicated by the arrow L and the pressing unit 305 is pressed (the separation lever 136 is moved to a position where it presses the cartridge 132 mounted on the mounting portion), the development unit 300 is rotated around the support shaft 314 in a direction indicated by an arrow K. Then, when the development unit 300 is rotated around the support shaft 314 in the direction indicated by the arrow K, the tension spring 320 is stretched. As a result, the development roller 301 is brought into the state being separated from the photosensitive drum 134 (at this time, the relative position of the development roller 301 with respect to the photosensitive drum 134 is placed at the separation position where the development roller 301 is separated from the photosensitive drum 134).

FIG. 4D illustrates the state in which the development roller 301 is separated from the photosensitive drum 134 as viewed from a top surface of the image forming apparatus 1. A space 400 where the cartridges 132*a* to 132*d* are mounted on the mounting portion of the image forming apparatus 1 is illustrated with a main body front surface side F and a main body back surface side B placed at a lower side and an upper side, respectively. This illustration indicates that the separation lever 136 is moved in the direction indicated by the arrow L and the development roller 301 is separated from the photosensitive drum 134 (in other words, the separation lever 136 presses the cartridges 132*a* to 132*d* mounted on the mounting portion of the image forming apparatus 1).

Further, the development unit 300 including the pressing unit 305 is partially recessed on the main body back surface side B thereof, and has an inclined surface portion 401. A reason why the development unit 300 is partially recessed will be described below in a description regarding an insertion force exerted when the cartridge 132 is inserted into the main body of the image forming apparatus 1 illustrated in FIGS. 6A and 6B.

On the other hand, as illustrated in FIG. 4C, the separation lever 136 is moved in the direction indicated by the arrow J, and the pressing on the pressing unit 305 is released (in other words, the separation lever 136 is moved to a position at which it does not press the cartridges 132*a* to 132*d* mounted on the mounting portion). Then, when the pressing on the pressing unit 305 is released, the development unit 300 is rotated around the support shaft 314 in a direction indicated by an arrow H, and the tension spring 320 is compressed. As a result, the development roller 301 is brought into the state abutting on the photosensitive drum 134 (at this time, the relative position of the development roller 301 with respect to the photosensitive drum 134 is placed at the contact position where the development roller 301 is in contact with the photosensitive drum 134).

Figure 4E:
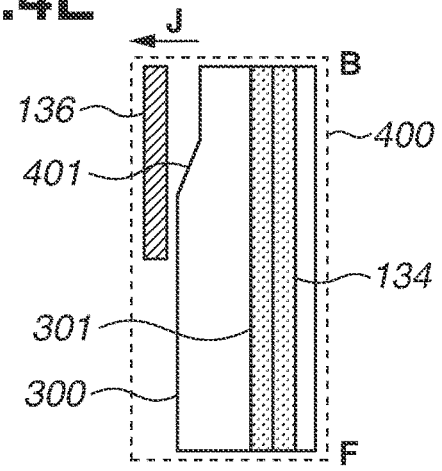

FIG. 4E illustrates the state in which the development roller 301 abuts on the photosensitive drum 134 as viewed from the top surface of the image forming apparatus 1. This illustration indicates that the separation lever 136 is moved in the direction indicated by the arrow J, and the development roller 301 abuts on the photosensitive drum 134 (in other words, the separation lever 136 does not press the cartridges 132*a* to 132*d* mounted on the mounting portion of the image forming apparatus 1).

In this manner, the mechanism is configured such that the development separation is performed when the pressing unit 305 is pressed by the separation lever 136 and the apparatus is in the development abutting state when the pressing unit 305 is released from the pressing by the separation lever 136, with respect to the cartridges 132*a* to 132*d* under the force of the tension spring 320 applied thereto.

In this manner, the development abutting/separation motor 241 moves the separation lever 136 between the position at which it presses the pressing unit 305, and the position at which the pressing on the pressing unit 305 is released. In other words, the development abutting/separation motor 241 fulfills a role as a movement mechanism that moves the separation lever 136 to a first position at which it presses the cartridge 132 mounted on the mounting portion of the image forming apparatus 1, and a second position at which it does not press the cartridge 132 mounted on the mounting portion.

<Description Regarding Development Abutting/Separation Position>

Figure 5A:
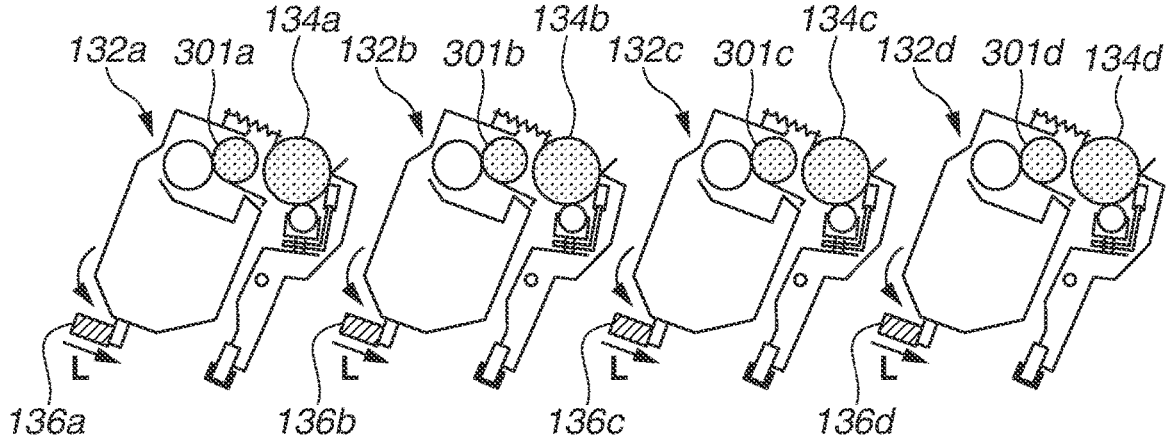
FIGS. 5A, 5B, and 5C illustrate positions of the abutting/separating the development roller.
Figure 5B:
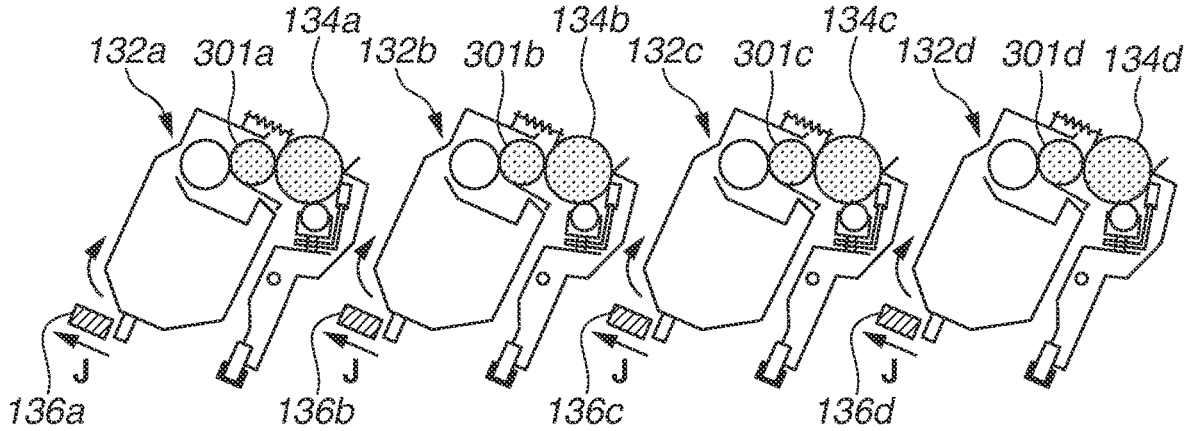
Figure 5C:
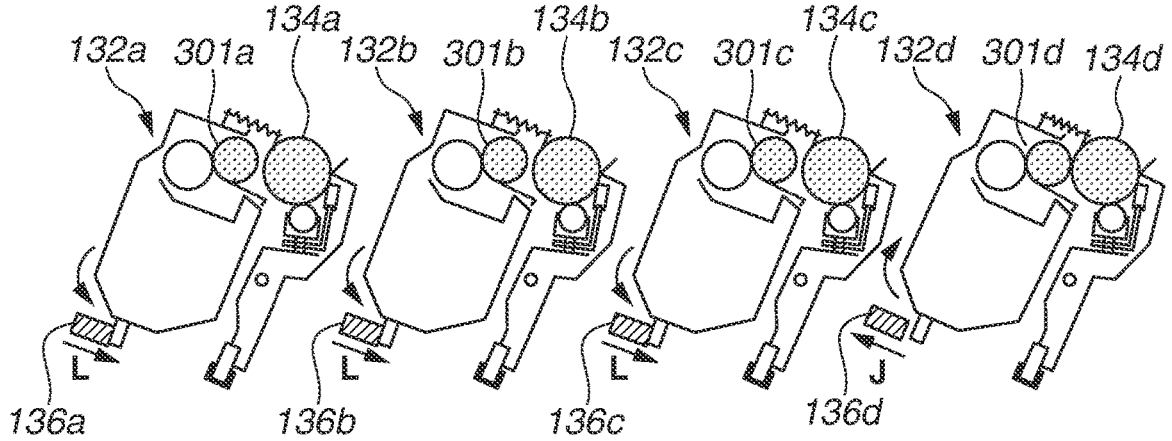

Next, types of development abutting/separation positions will be described with reference to FIGS. 5A to 5C. FIGS. 5A to 5C illustrate a development abutting/separation state of the cartridges 132*a* to 132*d* at each of the development abutting/separation positions. As illustrated in FIGS. 5A to 5C, the image forming apparatus 1 can switch among three types of development abutting/separation positions.

First, the position illustrated in FIG. 5A will be described. FIG. 5A illustrates a development abutting/separation state of the cartridges 132*a* to 132*d* in a standby state, which is a state waiting for reception of a print job.

If the development roller 301 is kept abutting on the photosensitive member 134 for a long period while the image formation is not carried out, the development roller 301 may warp and an image defect may occur when the image formation is carried out. It is desirable to keep the development roller 301 separated from the photosensitive member 134 when the image formation is not carried out, to prevent the occurrence of such an image defect.

Under these circumstances, when the image forming apparatus 1 is in a situation not requiring the image formation (when the image formation is not carried out), all of the cartridges 132*a* to 132*d* are set in the state where the development separation is performed (hereinafter referred to as a development all separation state), to prevent occurrence of a trouble in the image (an image defect) at the time of the next printing. Therefore, in the standby state, the image forming apparatus 1 moves all of the separation levers 136*a* to 136*d* in the direction indicated by the arrow L, thereby setting the apparatus in the development all separation state.

Next, the position illustrated in FIG. 5B will be described. FIG. 5B illustrate a development abutting/separation state of the cartridges 132*a* to 132*d* when a full-color image is printed.

When printing a full-color image (i.e., when carrying out the image formation), the image forming apparatus 1 forms the image with use of the toner of all of the yellow, magenta, cyan, and black colors. Therefore, the image forming apparatus 1 brings all of the cartridges 132*a* to 132*d* into the state where the apparatus executes the development abutting (hereinafter referred to as a development full-color abutting state). Therefore, when printing the full-color image, the image forming apparatus 1 sets the development full-color abutting state by moving all of the separation levers 136*a* to 136*d* in the direction indicated by the arrow J.

Next, the position illustrated in FIG. 5C will be described. FIG. 5C illustrate the development abutting/separation state of the cartridges 132*a* to 132*d* when a monochrome image is printed.

When printing a monochrome image (i.e., when carrying out the image formation), the image forming apparatus 1 forms the image with use of only the black toner without using the yellow toner, the magenta toner, and the cyan toner. Therefore, the image forming apparatus 1 brings the unused yellow, magenta, and cyan cartridges 132*a* to 132*c* into the state where the apparatus executes the development separation, and brings only the used black cartridge 132*d* into the state where the apparatus executes the development abutting (hereinafter referred to as a development monochrome abutting state). Therefore, when printing the monochrome image, the image forming apparatus 1 enters the development monochrome abutting state by moving the separation levers 136*a* to 136*c* in the direction indicated by the arrow L and moving the separation lever 136*d* in the direction indicated by the arrow J.

The three types of positions, namely, the development all separation state, the development full-color abutting state, and the development monochrome abutting state described above with reference to FIGS. 5A to 5C are switched by driving the development abutting/separation motor 241. More specifically, the development abutting/separation motor 241 is driven by a predetermined rotational amount at a time. Thus, the image forming apparatus 1 can switch the state positions by repeatedly setting the development all separation state (FIG. 5A) to the development full-color abutting state (FIG. 5B) to the development monochrome abutting state (FIG. 5C) to the development all separation state (FIG. 5A) to . . . sequentially in this order.

<Insertion Force when Cartridge is Inserted into Mounting Portion of Image Forming Apparatus>

Figure 6A:
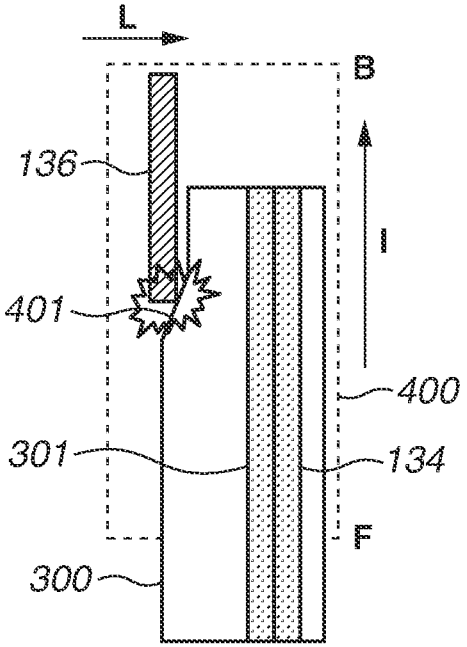
FIGS. 6A and 6B illustrate a force of inserting the cartridge according to a comparative example.
Figure 6B:
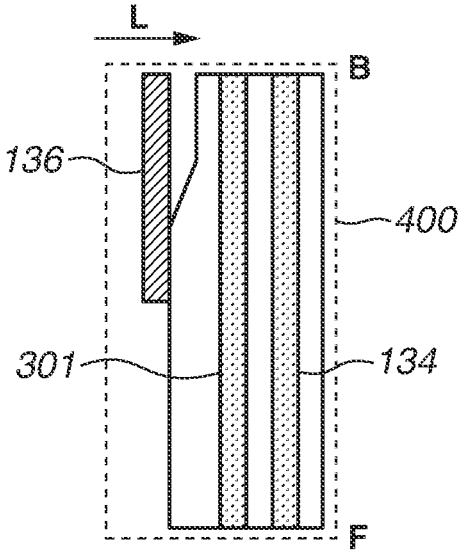
Figure 7A:
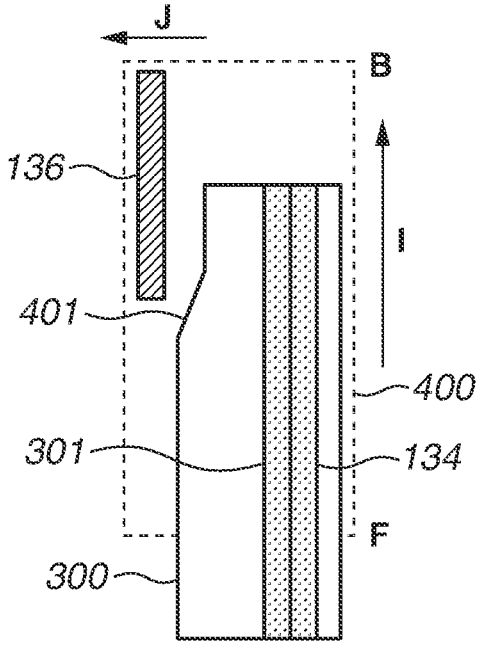
FIGS. 7A and 7B illustrate the force of inserting the cartridge according to a first example embodiment.
Figure 7B:
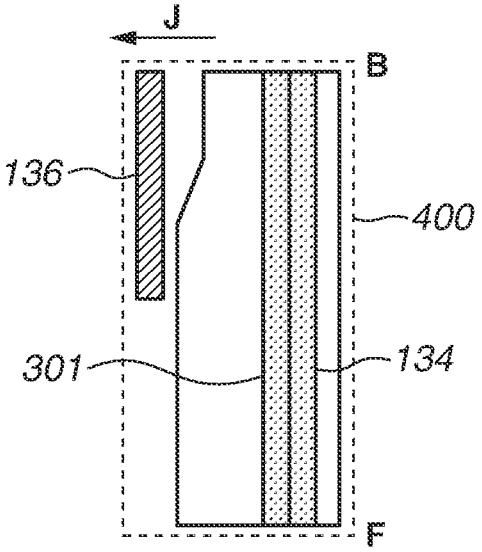

Next, the insertion force when the cartridges 132*a* to 132*d* are inserted into the mounting portion of the image forming apparatus 1 will be described with reference to FIGS. 6A and 6B, and 7A and 7B. FIGS. 6A and 6B, and 7A and 7B illustrate how the cartridges 132*a* to 132*d* are inserted when the image forming apparatus 1 is viewed from the top surface thereof. FIGS. 6A and 6B illustrate a comparative example, and FIGS. 7A and 7B illustrate the first example embodiment.

First, the insertion force when the cartridges 132*a* to 132*d* are inserted in the state where the separation levers 136*a* to 136*d* are moved in the direction indicated by the arrow L (the comparative example) will be described with reference to FIGS. 6A and 6B.

When the cartridges 132*a* to 132*d* are not mounted on the mounting portion of the image forming apparatus 1 as described above with reference to FIG. 4A, the development roller 301 and the photosensitive drum 134 are set in the abutting state on each other due to the force of the tension spring 320 as described above with reference to FIG. 3.

Then, when the cartridge 132 is inserted in a direction indicated by an arrow I (the direction from the front surface side F toward the back surface side B of the apparatus 1) in the state where the separation lever 136 is moved in the direction indicated by the arrow L, the inclined surface portion 401 of the development unit 300 contacts the separation lever 136 in the middle of the insertion, as illustrated in FIG. 6A. When the cartridges 132*a* to 132*d* are further pushed in from there in the direction indicated by the arrow I, the pressing unit 305 of the development unit 300 is pressed while the insertion continues as the separation lever 136 is tracing the inclined surface portion 401.

When the insertion of the cartridges 132*a* to 132*d* is completed (i.e., when the cartridges 132*a* to 132*d* are mounted on the mounting portion of the image forming apparatus 1), the development roller 301 is brought into the state being separated from the photosensitive drum 134 as illustrated in FIG. 6B. The development unit 300 is partially recessed and is in the shape of the inclined surface at the portion corresponding to the inclined surface portion 401 to allow the cartridges 132*a* to 132*d* to be mounted onto the mounting portion of the image forming apparatus 1 even in the state where the separation lever 136 has been moved in the direction indicated by the arrow L.

However, the user is supposed to push in the cartridges 132*a* to 132*d* by exerting a force so as to stretch the tension spring 320 under the force applied in the direction of making the photosensitive drum 134 and the development roller 301 abut on each other, after the inclined surface portion 401 contacts the separation lever 136. Therefore, a load is imposed by this work and requires a great insertion force when the cartridges 132*a* to 132*d* are inserted onto the mounting portion of the image forming apparatus 1.

Next, the insertion force exerted when the cartridges 132*a* to 132*d* are inserted in the state where the separation lever 136 has been moved in the direction indicated by the arrow J (the first example embodiment) will be described with reference to FIGS. 7A and 7B.

When the cartridges 132*a* to 132*d* are inserted in the direction indicated by the arrow I in the state where the separation lever 136 has been moved in the direction indicated by the arrow J, the inclined surface portion 401 of the development unit 300 does not contact the separation lever 136 as illustrated in FIG. 7A. Therefore, a great insertion force is not required when the cartridges 132*a* to 132*d* are inserted into the mounting portion of the image forming apparatus 1.

When the insertion of the cartridges 132*a* to 132*d* is completed (i.e., when the cartridges 132*a* to 132*d* are mounted on the mounting portion of the image forming apparatus 1), the development roller 301 and the photosensitive drum 134 are kept abutting on each other as illustrated in FIG. 7B.

Thus, the force required when the cartridge 132 is inserted can be reduced in the state where the separation lever 136 has been moved in the direction indicated by the arrow J as illustrated in FIG. 7A, compared to when the cartridge 132 is inserted in the state where the separation lever 136 has been moved in the direction indicated by the arrow L as illustrated in FIG. 6A.

The insertion force when the cartridges 132*a* to 132*d* are inserted into the mounting portion of the image forming apparatus 1 has been described in the description about the above-described drawings, FIGS. 6A and 6B, and 7A and 7B, but a detachment force when the cartridges 132*a* to 132*d* are detached from the mounting portion of the image forming apparatus 1 can also be described similarly.

More specifically, as a comparative example, the cartridges 132*a* to 132*d* are detached from the mounting portion of the image forming apparatus 1 in the state where the separation lever 136 has been moved in the direction indicated by the arrow L as illustrated in FIG. 6A. Further, as the first example embodiment, the cartridges 132*a* to 132*d* are detached from the mounting portion of the image forming apparatus 1 in the state where the separation lever 136 has been moved in the direction indicated by the arrow J as illustrated in FIG. 7A. In this case, the force required when the cartridge 132 is detached can be reduced in the state where the separation lever 136 has been moved in the direction indicated by the arrow J (the first example embodiment), compared to when the cartridge 132 is detached in the state where the separation lever 136 has been moved in the direction indicated by the arrow L (the comparative example).

In the first example embodiment, as described above with reference to FIGS. 5A to 5C, the separation lever 136 presses the cartridge 132 mounted on the mounting portion of the image forming apparatus 1 to keep the development roller 301 in the state being separated from the photosensitive drum 134 when the image formation is not carried out. However, as described above with reference to FIGS. 6A and 6B, when the cartridge 132 is attached and detached to/from the mounting portion in the state where the separation lever 136 is placed at the position where it presses the cartridge 132 mounted on the mounting portion, resistance is developed subject to the pressing by the separation lever 136, which makes the smooth attachment/detachment of the cartridge difficult.

On the other hand, as described above with reference to FIG. 5A, it is desirable to keep the development rollers 301*a* to 301*d* separated from the photosensitive drums 134*a* to 134*d*, respectively, when the image formation is carried out, in order to prevent the occurrence of a trouble in the image (prevent the occurrence of an image defect). This specifically means moving the separation levers 136*a* to 136*d* in the direction indicated by the arrow L to keep them all in the development separation state as illustrated in FIG. 5A.

Therefore, in the first example embodiment, the image forming apparatus 1 is configured to make the development roller 301 abut on the photosensitive member when the image formation is carried out and separate the development roller 301 from the photosensitive member when the image formation is not carried out, and is configured to allow the cartridge 132 to be smoothly attached and detached at the time of replacement of the cartridge 132 when the image formation is not carried out. In the following description, details thereof will be described.

Example of Control According to First Example Embodiment

Processing of the development abutting/separation according to the first example embodiment will be described with reference to a flowchart illustrated in FIG. 8. The CPU 200 performs the example control illustrated in FIG. 8 by controlling various kinds of devices. Further, in the control example illustrated in FIG. 8, the flow is started according to detection by the front door open/close sensor 250 (the open/close detection unit) that the front door (the main body cover) of the image forming apparatus 1 is closed.

In step S801, the CPU 200 stores information indicating that the front door is closed as a previous state ("the previous state=closed") into the RAM 202.

In step S802, the CPU 200 acquires a current state from the front door open/close sensor 250, and stores information regarding the opening/closing of the front door into the RAM 202 as the current state.

In step S803, the CPU 200 determines whether the current state and the previous state match with each other as the information regarding the opening/closing of the front door that is stored in the RAM 202. If the previous state and the current state are different from each other (NO in step S803), the processing proceeds to step S804. Then, in step S804, the CPU 200 stores the information regarding the opening/closing of the front door acquired as the current state in the RAM 202 as the previous state. Subsequently, in step S805, the CPU 200 determines whether the information regarding the opening/closing of the front door as the current state that is stored in the RAM 202 is information indicating that the front door is in the opened state as the current state (the current state="opened").

If the information indicating that the front door is in the opened state as the current state (the current state="opened"), is stored in the RAM 202 (YES in step S805), the processing proceeds to step S806. In step S806, the CPU 200 brings the cartridges 132*a* to 132*d* into the development full-color abutting state as illustrated in FIG. 5B by driving the development abutting/separation motor 241. After that, the processing returns to step S802.

On the other hand, if the information indicating that the front door is in the opened state as the current state is not stored in the RAM 202 (i.e., the information indicating that the front door is in the closed state as the current state, is stored in the RAM 202) (NO in step S805), the processing proceeds to step S807. Then, in step S807, the CPU 200 brings the cartridges 132*a* to 132*d* all into the development separation state as illustrated in FIG. 5A by driving the development abutting/separation motor 241. After that, the processing returns to step S802.

If the previous state and the current state match with each other (YES in step S803) when the CPU 200 determines whether the current state and the previous state match with each other as the information regarding the opening/closing of the front door that is stored in the RAM 202 in step S803, the processing proceeds to step S808. In step S808, the CPU 200 determines whether the information indicating that the front door is in the opened state as the current state (the current state="opened"), is stored in the RAM 202.

If the information indicating that the front door is in the opened state as the current state (the current state="opened") is stored in the RAM 202 (YES in step S808), the processing returns to step S802. On the other hand, if the information indicating that the front door is in the opened state as the current state, is not stored in the RAM 202 (i.e., the information indicating that the front door is in the closed state as the current state, is stored in the RAM 202) (NO in step S808), the processing proceeds to step S809.

In step S809, the CPU 200 determines whether there is print information acquired. If there is no acquired print information (NO in step S809), the processing returns to step S802, and the CPU 200 continues the processing for monitoring a print job. On the other hand, if there is print information acquired (YES in step S809), the processing proceeds to step S810.

In step S810, the CPU 200 analyzes the acquired print information, and determines whether the image to print is a full-color image or a monochrome image. If the image to print is the full-color image (YES in step S810), the processing proceeds to step S811. In step S811, the CPU 200 brings the cartridges 132*a* to 132*d* into the development full-color abutting state as illustrated in FIG. 5B by driving the development abutting/separation motor 241 similarly to step S806. After that, the processing proceeds to step S813.

On the other hand, if the image to print is the monochrome image (NO in step S810), the processing proceeds to step S812. In step S812, the CPU 200 brings the cartridges 132*a* to 132*d* into the development monochrome abutting state as illustrated in FIG. 5C by driving the development abutting/separation motor 241. After that, the processing proceeds to step S813.

In step S813, the CPU 200 controls the image forming unit 220. Then, the image forming unit 220 forms the image on the sheet P fed from the sheet feeding cassette 100 when the image formation is carried out. After the image is formed on the sheet P, the sheet P is discharged onto the sheet discharge tray 160. Then, the processing proceeds to step S814. In step 814, the CPU 200 determines whether there is a page that should be printed based on a result of analyzing the acquired print information. If there is a page that should be printed (i.e., printing of all pages is not ended) (NO in step S814), the processing returns to step S810, and the CPU 200 continues the printing (continues the image forming operation). On the other hand, if there is no page that should be printed (i.e., the printing is entirely ended) (YES in step S814), the processing proceeds to step S815.

In step S815, the CPU 200 brings the cartridges 132*a* to 132*d* all into the development separation state as illustrated in FIG. 5A by driving the development abutting/separation motor 241 similarly to step S807. After that, the processing returns to step S802, and the CPU 200 continues the processing for monitoring a print job.

Figure 8:
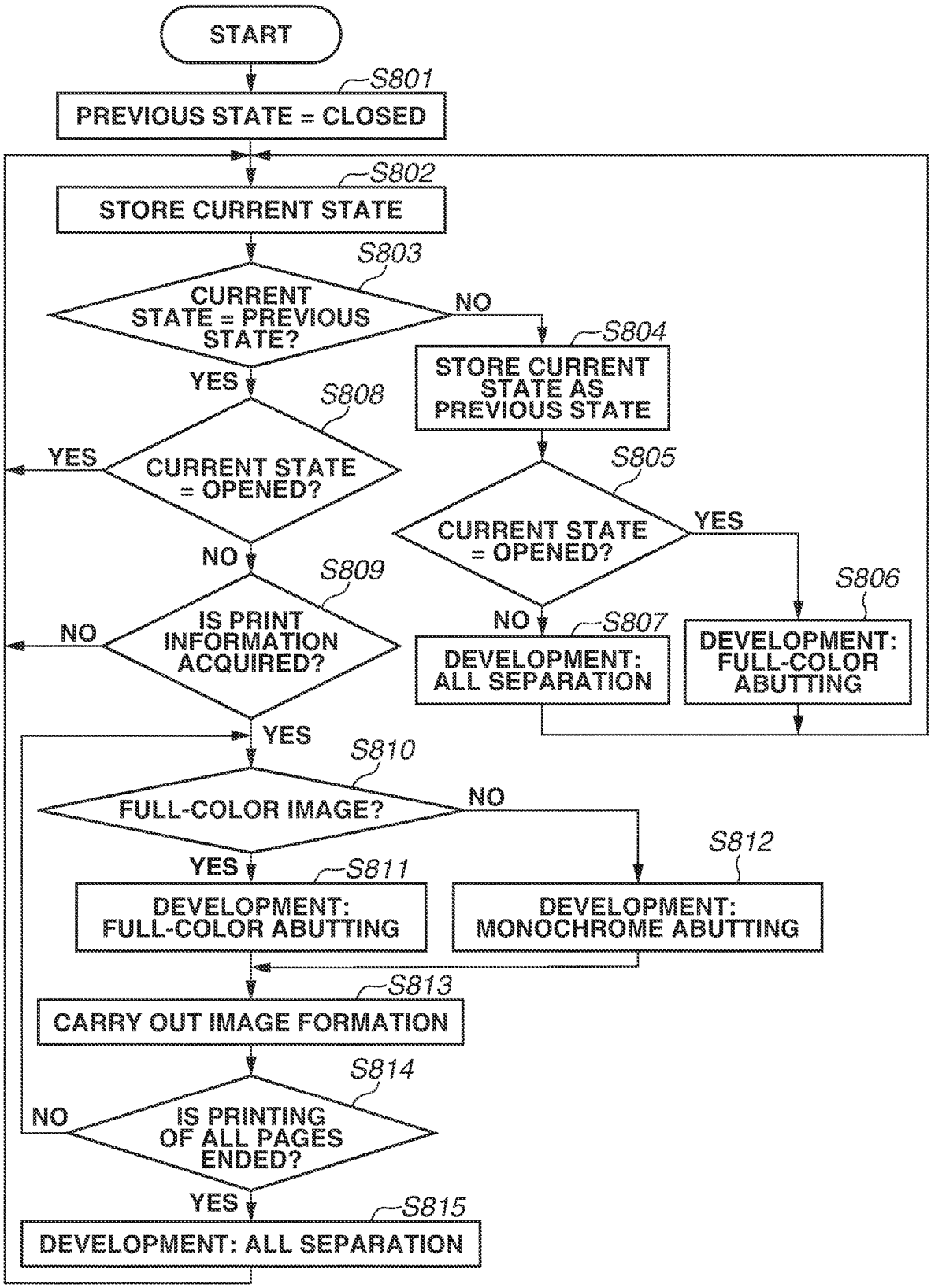
FIG. 8 is a flowchart illustrating an example of control according to the first example embodiment.

In the control example illustrated in FIG. 8, all the separation levers 136*a* to 136*d* are moved in the direction indicated by the arrow J in a similar manner to when the development full-color abutting state is set as illustrated in FIG. 5B, when the user opens the front door (the main body cover) of the image forming apparatus 1 to replace the cartridge 132. As a result, all the separation levers 136*a* to 136*d* are brought into a state when all the levers moved in the direction indicated by the arrow J illustrated in FIG. 5B when the user inserts the cartridges 132*a* to 132*d* into the mounting portion of the image forming apparatus 1 in the state where the front door of the image forming apparatus 1 is opened.

More specifically, as described above with reference to FIG. 7A, when the cartridges 132*a* to 132*d* are inserted in the direction indicated by the arrow I in a state where the separation lever 136 has been moved in the direction indicated by the arrow J, the inclined surface portion 401 of the development unit 300 does not contact the separation lever 136. Therefore, since no resistance is developed subject to the pressing by the separation lever 136 when the cartridges 132*a* to 132*d* are inserted into the mounting portion of the image forming apparatus 1, the present configuration can reduce the force required when the cartridge 132 is inserted into the mounting portion without requiring a great insertion force. Similarly, the present configuration can also reduce the force required when the cartridges 132*a* to 132*d* are detached from the mounting portion of the image forming apparatus 1.

Further, in the control example illustrated in FIG. 8, the cartridges 132*a* to 132*d* are all kept in the development separation state as illustrated in FIG. 5A until the user opens the front door of the image forming apparatus 1 to replace the cartridge 132 when the image formation is not carried out (refer to step S815 illustrated in FIG. 8). Therefore, the image forming apparatus 1 can prevent the occurrence of an image defect like a defect that might occur when the development roller 301 is kept abutting on the photosensitive drum 134 for a long period although the image formation is not carried out. On the other hand, in the control example illustrated in FIG. 8, the cartridges 132*a* to 132*d* are brought into the development full-color abutting state as illustrated in FIG. 5B when the user opens the front door of the image forming apparatus 1 at the time of the replacement of the cartridge 132 when the image formation is not carried out (refer to step S806 illustrated in FIG. 8).

In other words, in the first example embodiment, the image forming apparatus 1 is configured to bring the cartridges 132*a* to 132*d* into the development full-color abutting state along with the detection by the door open/close sensor 205 that the front door is opened, even if the apparatus is configured to keep the cartridges 132*a* to 132*d* all in the development separation state when the image formation is not carried out. Therefore, in the first example embodiment, the apparatus is configured to bring the development roller 301 into the abutting on the photosensitive drum 134 when the image formation is carried out and separate the development roller 301 from the photosensitive drum 134 when the image formation is not carried out, while the cartridge 132 can be smoothly attached and detached at the time of the replacement thereof when the image formation is not carried out.

Further, in the control example illustrated in FIG. 8, the image forming apparatus 1 is configured to bring the cartridge 132 into the development all separation state along with the detection by the front door open/close sensor 250 that the front door of the image forming apparatus 1 is closed, after the cartridge 132 is mounted onto the mounting portion of the image forming apparatus 1 (refer to step S807). Therefore, in the first example embodiment, the image forming apparatus 1 can prevent the development roller 301 from being kept abutting on the photosensitive drum 134 for a long time while the image formation is not carried out, thereby preventing the development roller 301 from warping, so that an image defect is prevented from occurring when the image formation is carried out.

According to the above-described first example embodiment, the apparatus is configured to bring the development roller into the abutting on the photosensitive member when the image formation is carried out and separate the development roller from the photosensitive member when the image formation is not carried out, while the operability when the cartridge is attached to and detached from the mounting portion when the image formation is not carried out can be improved.

Other Example Embodiments

The present disclosure is not limited to the above-described example embodiment. This example embodiment can be modified in various manners (including an organically coordinated combination of each example embodiment) based on the spirit of the present disclosure, and such modifications are not excluded from the scope of the present disclosure.

The above-described example embodiment has been described referring to the example where the detection by the front door open/close sensor 250 that the front door of the image forming apparatus 1 is opened, is used as a trigger for transition from the development all separation state to the development full-color abutting state when the image formation is not carried out. The present disclosure is not limited thereto, and may be embodied by an example modification using the detection by the cartridge presence/absence sensor 240 that the cartridge 132 is not mounted on the mounting portion of the image forming apparatus 1, as a trigger for the transition from the development all separation state to the development full-color abutting state when the image formation is not carried out. Further, the present disclosure may be embodied also by an example modification configured in the following manner. That is, when the cartridge presence/absence sensor 240 detects that only the cartridge 132*d* of the black color is not mounted on the mounting portion of the image forming apparatus among the cartridges 132*a* to 132*d* of the yellow, magenta, cyan, and black colors, the cartridges 132*a* to 132*d* are brought into the development monochrome abutting state as illustrated in FIG. 5C instead of bringing the cartridges 132*a* to 132*d* into the development full-color abutting state as illustrated in FIG. 5B.

Further, the above-described example embodiment has been described referring to the example using the detection by the front door open/close sensor 250 that the front door of the image forming apparatus 1 is closed as a trigger for the transition from the development full-color abutting state to the development all separation state when the image formation is not carried out. The present disclosure is not limited thereto, and may be embodied by an example modification using the detection by the cartridge presence/absence sensor 240 that the cartridge 132 is mounted on the mounting portion of the image forming apparatus 1 as a trigger for the transition from the development full-color abutting state to the development all separation state when the image formation is not carried out.

Further, in the above-described example embodiment, the image forming apparatus 1 primarily transfers the toner image borne on each of the photosensitive drums 134*a* to 134*d* onto the intermediate transfer belt 131 as illustrated in FIG. 1. After that, the image forming apparatus 1 secondarily transfers the toner image borne on the intermediate transfer belt 131 onto the sheet P by bringing the sheet P into contact with the intermediate transfer belt 131. The above-described example embodiment has been described based on the image forming apparatus 1 configured in this manner as an example, but the present disclosure is not limited thereto. The present disclosure can also be applied to an image forming apparatus 1 configured to directly transfer the toner image borne on the photosensitive drum 134 onto the sheet P by bring the sheet P into direct contact with the photosensitive drum 134.

Further, the above-described example embodiment has been described based on the image forming apparatus 1 that includes the mounting portion to which the cartridge 132 of each of the yellow, magenta, cyan, and black colors can be detachably attached (a color apparatus) as an example, but the present disclosure is not limited thereto. The present disclosure can also be applied to an image forming apparatus that includes a mounting portion to which only the cartridge of the black color can be detachably attached (a monochrome apparatus). In other words, the present disclosure can be applied to an image forming apparatus regardless of whether the apparatus is the color apparatus or the monochrome apparatus as long as it is an image forming apparatus to which the cartridge including the photosensitive drum 134 (the photosensitive member) and the development roller 301 (the developer bearing member) can be detachably attached.

Additionally, embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-033289, filed Feb. 26, 2019, which is hereby incorporated by reference herein in its entirety.

What is claimed is:

1. An image forming apparatus including a mounting portion to which a cartridge can be mounted, the cartridge including a photosensitive member and a developer bearing member configured to bear a developer for developing an electrostatic latent image formed on the photosensitive member, the image forming apparatus comprising:

a pressing member configured to press the cartridge mounted on the mounting portion;

a movement mechanism configured to move the pressing member between a first position and a second position, wherein at the first position, pressing of the cartridge mounted on the mounting portion by the pressing member is performed so that a position of the developer bearing member relative to the photosensitive member becomes a separation position where the developer bearing member is separated from the photosensitive member, and at the second position, the pressing of the cartridge mounted on the mounting portion by the pressing member is released so that the position of the developer bearing member relative to the photosensitive member becomes a contact position where the developer bearing member is in contact with the photosensitive member;

a guide portion that guides insertion of the cartridge from a frontal side toward a back side of the image forming apparatus so as to mount the cartridge on the mounting portion;

an openable and closable main body cover; and a detection unit configured to detect opening and closing of the main body cover, wherein in a case where the pressing member is located at the first position, when the cartridge is inserted from the frontal side toward the back side of the image forming apparatus while being guided by the guide portion, the cartridge comes into contact with the pressing member, and in a case where the pressing member is located at the second position, when the cartridge is inserted from the frontal side toward the back side of the image forming apparatus while being guided by the guide portion, the cartridge does not come into contact with the pressing member, wherein along with start of an image forming operation, the movement mechanism moves the pressing member from the first position to the second position, and along with end of the image forming operation, the movement mechanism moves the pressing member from the second position to the first position, wherein when the image forming operation is not performed, in conjunction with detecting by the detection unit that the main body cover is opened from a closed state of the main body cover, the movement mechanism moves the pressing member from the first position to the second position, and when the image forming operation is not performed, in conjunction with detecting by the detection unit that the main body cover is closed from an open state of the main body cover, the movement mechanism moves the pressing member from the second position to the first position.

2. The image forming apparatus according to claim 1, further comprising:

a mounting detection unit that detects mounting of the cartridge onto the mounting portion;

wherein the pressing member is located at the second position in a state in which the mounting detection unit does not detect that the cartridge is mounted.

3. The image forming apparatus according to claim 1, further comprising:

a receiving unit configured to receive an image forming job;

wherein the pressing member is located at the first position in a state in which the receiving unit is waiting for receiving the image forming job.

4. The image forming apparatus according to claim 1, wherein the movement mechanism is a motor that drives the pressing member for movement between the first position and the second position.

5. The image forming apparatus according to claim 1, wherein the pressing member is a lever provided on the mounting portion.

* * * * *